US006543371B1

(12) United States Patent
Gardner

(10) Patent No.: US 6,543,371 B1
(45) Date of Patent: Apr. 8, 2003

(54) MODULAR VAULT PANEL

(75) Inventor: Richard P. Gardner, Fairfield, OH (US)

(73) Assignee: Diebold, Incorporated, North Canton, OH (US)

( * ) Notice: Subject to any disclaimer, the term of this patent is extended or adjusted under 35 U.S.C. 154(b) by 0 days.

(21) Appl. No.: 09/477,237

(22) Filed: Jan. 4, 2000

(51) Int. Cl.[7] ..... E04B 2/02

(52) U.S. Cl. ..... 109/83; 109/80; 109/84; 52/601

(58) Field of Search ..... 109/49.5, 80, 82–85; 52/600, 601, 414

(56) References Cited

U.S. PATENT DOCUMENTS

| | | | | | |
|---|---|---|---|---|---|
| 129,795 | A | * | 7/1872 | Crump | 109/83 |
| 1,826,768 | A | * | 10/1931 | Gialdini | 109/83 |
| 1,873,246 | A | * | 8/1932 | Abbott | 109/83 |
| 1,873,523 | A | * | 8/1932 | Abbott | 109/83 |
| 2,458,242 | A | * | 1/1949 | Bescherer | 109/83 |
| 2,969,619 | A | * | 1/1961 | Didrick | 50/437 |
| 3,123,025 | A | * | 3/1964 | Fugelstad | 109/83 |
| 3,732,831 | A | | 5/1973 | Marciniak et al. | 109/83 |
| 4,119,597 | A | * | 10/1978 | Enoue | 260/23 R |
| 4,158,338 | A | * | 6/1979 | Dippold et al. | 109/79 |
| 4,389,948 | A | | 6/1983 | Sands et al. | 109/82 |
| 4,505,208 | A | * | 3/1985 | Goldman | 109/85 |
| 4,559,881 | A | | 12/1985 | Lankard et al. | 109/83 |
| 4,593,627 | A | | 6/1986 | Lankard et al. | 109/83 |
| 4,765,254 | A | * | 8/1988 | Goldman | 109/85 |
| 5,050,507 | A | | 9/1991 | Shoyat | 109/83 |
| 6,202,375 | B1 | * | 3/2001 | Kleinschmidt | 52/281 |

FOREIGN PATENT DOCUMENTS

| | | | |
|---|---|---|---|
| FR | 2365680 | 4/1978 | 1/24 |

* cited by examiner

*Primary Examiner*—Anthony Knight
*Assistant Examiner*—John B. Walsh
(74) *Attorney, Agent, or Firm*—Wood, Herron & Evans, L.L.P.

(57) ABSTRACT

A modular concrete vault panel including two opposed metal side rails and two opposed metal end rails having ends rigidly connected to ends of the side rails to form a metal rectangular frame. A rebar lattice is supported within the frame, and waveform rebar extends longitudinally within the frame. The frame is then filled with a high compression strength concrete to produce the modular concrete vault panel.

26 Claims, 4 Drawing Sheets

5B

MODULAR VAULT PANEL

FIELD OF THE INVENTION

The present invention relates to security vaults and more particularly, to an improved modular vault panel.

BACKGROUND OF THE INVENTION

In the past, vaults for storing safety deposit boxes and reserve money were constructed of poured concrete walls approximately 18–36 inches thick and were very difficult and expensive to construct in a new bank structure. The time required to erect concrete forms, install the reinforcing materials, pour the concrete, strip the forms and let the concrete cure added significant time and cost to the construction of new bank structures. Further, that process made the installation of a vault almost impossible in an existing building.

A number of years ago, regulatory authorities specified the construction of a vault wall for a particular application. However, over the last 25 years, rather than specifying a particular construction, the regulatory authorities now specify only the burglary resistance of a vault as set forth in Underwriters Laboratories, Inc. Specification for Vaults UL 608. The UL 608 specification classifies the burglary resistance of a vault according to the length of time the vault is able to withstand an attack by common burglary tools. For example, class M vaults resist attack for one-quarter an hour, class 1 vaults for one-half an hour, class 2 vaults for one hour and class 3 vaults for two hours. Once a vault classification has been established for a particular application, vault manufacturers are able to use any construction that meets the burglary resistance UL certification requirements of the classification. Therefore, manufacturers of vaults now compete to provide more efficient and effective constructions that meet the particular specifications of a class of vault.

A major improvement and cost savings in vault construction over the past 25 years is the use of prefabricated concrete panels. Such panels are manufactured off-site by the vault manufacturer, shipped to the bank building construction site and assembled into a floor, walls and ceiling of a finished vault. The use of such panels to construct a vault is substantially more efficient, less costly and easier than the earlier on-site poured concrete constructions. The modular vault construction has the further advantage of being easily disassembled and moved to another facility if the bank business moves.

As will be appreciated, the design of the specific structure of a prefabricated concrete panel is directed to a particular market represented by one of the vault classifications in the UL specification. In order to be competitive within that market, there is a continuing effort to reduce vault panel costs while maintaining a structural integrity to meet the specifications of the desired UL class. All of the prefabricated concrete panels are constructed of a reinforced high compression strength concrete. The design of the reinforcing, the composition of the concrete and other elements will vary depending on the vault manufacturer; however, generally, prefabricated concrete panels that meet a class 1 UL specification are at least six inches thick.

Thus, there is a continuing need to make the construction of the reinforced concrete panel more economical without reducing its resistance to burglary.

SUMMARY OF THE INVENTION

The present invention provides an improved modular concrete panel for a vault that is smaller and lighter than comparable panels having the same resistance to burglary. Further, the panel is less expensive to manufacture, less expensive to transport and easier to handle during the construction process. Thus, the modular concrete panel of the present invention is particularly well suited for installation in existing structures and has the further advantage of being able to be disassembled and moved to another location.

In accordance with the principles of the present invention and the described embodiments, the invention provides a modular concrete vault panel including two opposed metal side rails and two opposed metal end rails having ends rigidly connected to ends of the side rails to form a metal rectangular frame. A rebar lattice is supported within the frame, and waveform rebar extends longitudinally within the frame. The frame is then filled with a high compression strength concrete to produce the modular concrete vault panel.

In one aspect of the invention, the rebar lattice has a pair of lateral rebar rods and a pair of waveform rebars, each of the lateral rebar rods extends adjacent one of the side rails and one of the waveform rebars is rigidly connected to one of the lateral rebar rods.

In another embodiment, the above-described modular concrete panel further includes a second pair of opposed metal side walls and a second pair of opposed metal end walls having ends rigidly connected to ends of the second side walls to form a second rectangular metal frame. A second rebar lattice is supported within the second frame, and a ventilation channel extends through the two frames.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

DETAILED DESCRIPTION OF THE INVENTION

Figure 1:
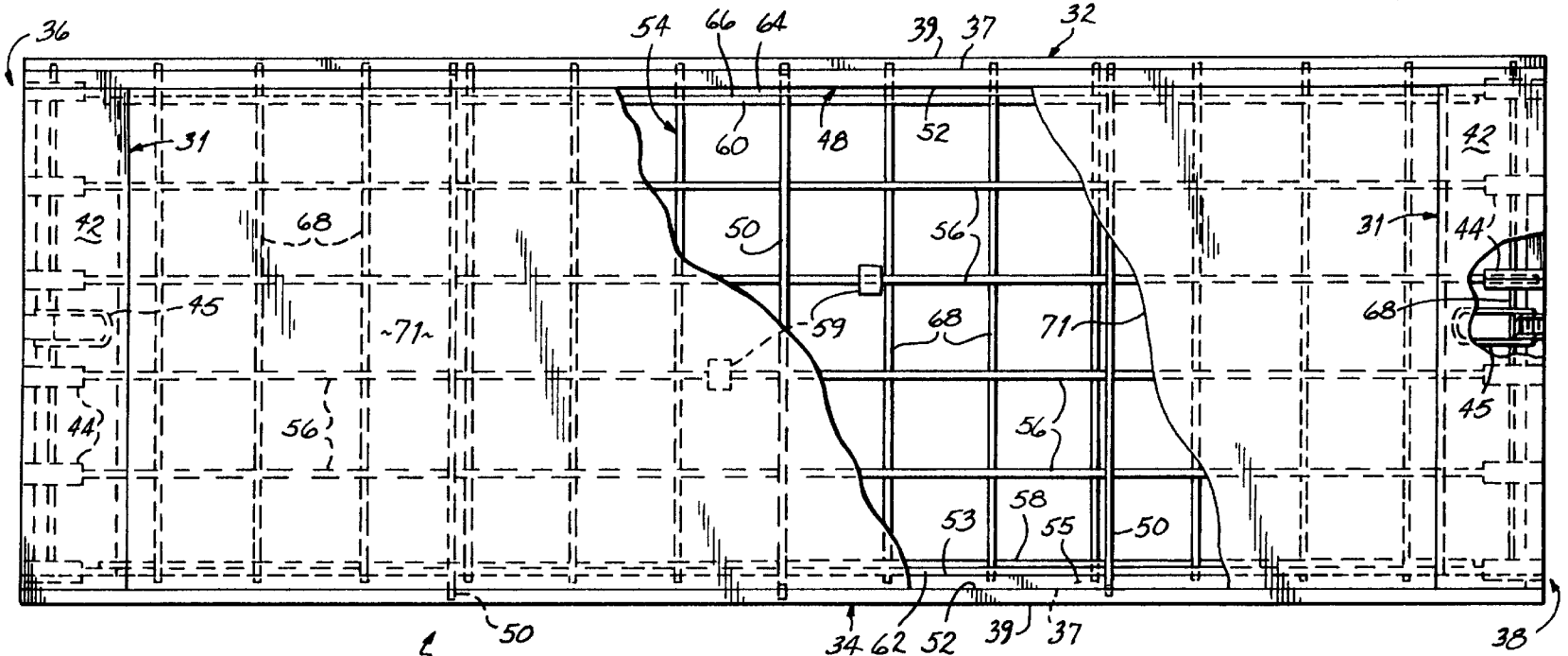
FIG. 1 is a bottom plan view of the modular concrete panel in accordance with the principles of the present invention.
Figure 2:
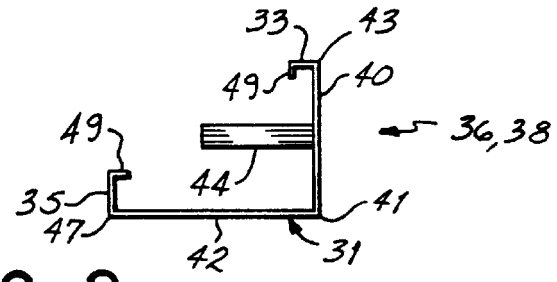
FIG. 2 is an end view of an end cap on the ends of the modular concrete panel of FIG. 1.

Referring to FIG. 1, a modular concrete vault panel 30 is comprised of opposed side rails 32, 34 having ends rigidly connected, for example, by welding, to the ends of end rails 36, 38, thereby forming a frame 48 for the panel 30. The end rails 36, 38 are identical in construction. As shown in FIG. 2, each of the end rails 36, 38 has an end wall 40 with one longitudinally extending lateral edge rigidly connected at 41 to a coextensive edge of an inside wall 42 such that the end wall 40 and inside wall 42 are approximately perpendicular to each other to form a generally L-shaped end cap 31. The end cap 31 further has an outer leg 33 having a longitudinally extending edge rigidly connected at 43 to a coextensive opposite edge of the end wall 40. The outer leg 33 is approximately perpendicular to the end wall 40 and approximately parallel to the inside wall 42. The end cap 31 also has an inner leg 35 having an edge rigidly connected at 47 to an opposite edge of the inside wall 42. The inner leg 35 is approximately perpendicular to the inside wall 42 and approximately parallel to the end wall 40. The inner and outer legs 33, 35 extend toward each other and toward the inside of the L-shaped end cap 31. The inner and outer legs 33, 35 have inner directed lips 49 and thus, are generally L-shaped as shown in FIG. 2. The width of the inside wall 42 as measured between its opposed edges at 41 and 47 is greater than the width of the end wall 42 as measured between its opposed edges at 41 and 43. The end caps 31 are fabricated from separate pieces as is known in the art or, are roll-formed from a 16 gauge steel.

Figure 3:
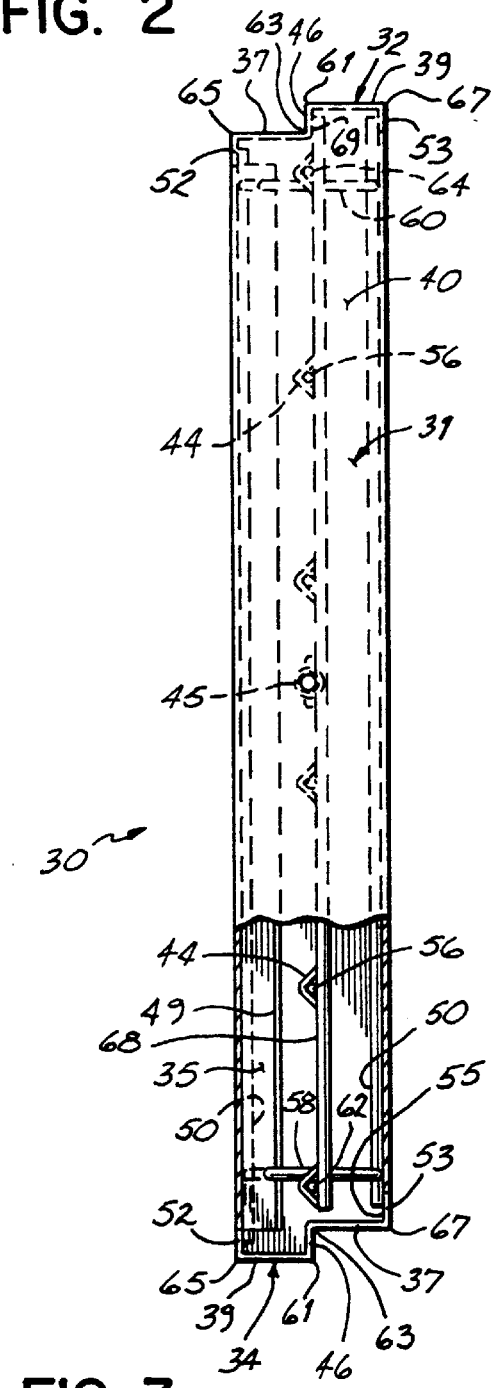
FIG. 3 is an end view of the modular concrete panel of FIG. 1.

As shown in FIGS. 2 and 3, each of the end rails 36, 38 further includes a plurality of support members 44 spaced approximately 6.5 inches apart and welded to an inside surface of the end wall 40. The support members 44 are approximately 4 inches long and have sides of approximately 0.50 inches in a generally V-shaped configuration. Each of the end rails 36, 38 further includes a centrally located lifting insert 45 having a threaded bore that receives a threaded stud of a lifting eye hook (not shown) in a known manner.

The side rails 32, 34 have a common construction, and each of the side rails 32, 34 has an inner side wall portion 37 and an outer side wall portion 39. A locking wall 46 has two opposed longitudinally extending lateral edges rigidly connected at 61 and 63 to coextensive edges of the inner and outer side wall portions 37, 39, respectively. The locking wall 46 is approximately perpendicular to the inner and outer side wall portions 37, 39 and causes the inner and outer side wall portions to be offset from each other by an amount equal to the width of the locking wall 46. The inner and outer side wall portions 37, 39 and the interconnecting locking wall 46 form a side rail having a stepped profile. Therefore, when the panels 30 are placed adjacent each other, side rails 32, 34 of one panel will be adjacent side rails 34, 32 of another panel; and the stepped profiles of the adjacent side rails will overlap to form a lock joint that maintains the panels 30 in a generally straight alignment along a wall section.

Each of the side rails 32, 34 further has an inner lip 52 with a longitudinally extending lateral edge rigidly connected at 65 along an opposite coextensive edge of the inner side wall portion 37, and an outer lip 53 has a longitudinally extending lateral edge rigidly connected at 67 to an opposite coextensive edge of the outer side wall portion 39. The respective inner and outer lips 52, 53 extend in the same direction and are approximately perpendicular to the inner and outer side wall portions 37, 39, respectively. The side rails 32, 34 are fabricated from separate pieces as is known in the art or, are roll-formed from a 16 gauge steel.

Figure 4:
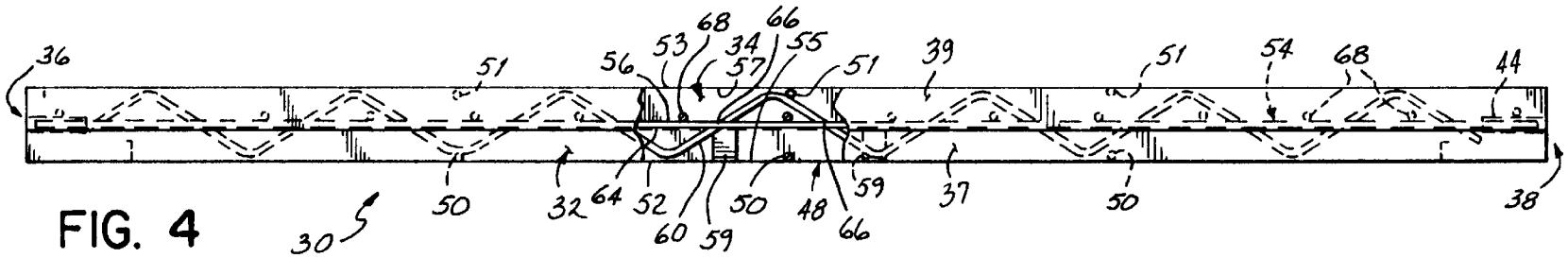
FIG. 4 is a side view of the modular concrete panel of FIG. 1.

Referring to FIGS. 1 and 4, a plurality of inner tie bars 50 extend across the width of the frame 48 and are welded to upper surfaces 55 of the inner lips 52 of the side rails 32, 34. Similarly, a plurality of outer tie bars 51 extend across the width of the frame 48 and are welded to lower surfaces 57 of outer lips 53 of the side rails 32, 34. Thus, the tie bars 50, 51 function to maintain the side rails 32, 34 of the frame 48 at their desired width and orientation during the construction of the panel 30. The tie bars 50, 51 are normally grade 60, #3 rebar. For purposes of this document, "rebar" is the common name of commercially available metal reinforcing bar stock.

Next, a reinforcing rebar lattice 54 is constructed within the frame 48 to provide additional strength. The lattice 54 has longitudinal bars or rods 56 placed within the panel frame 48. The ends of the longitudinal rods 56 are located in and rigidly connected to, for example, by welding, the support members 44 of the end rails 36, 38, thereby connecting the longitudinal rods 56 to the panel frame 48. Thus, the longitudinal rods 56 are separated by a spacing of approximately 6.5 inches. The longitudinal rods 56 have subjacent supports 59 along their lengths to maintain the rods 56 at a desired elevation within the frame 48. The number and exact location of the supports 59 can be varied in a known manner. The supports 59 are, for example, FF-700 mat chairs, commercially available as Part No. 80453 from Dayton-Superior of Dayton, Ohio.

When the modular vault panels 30 are assembled into a vault structure, many perceive the intersection of the panels 30 to be the weakest point and most subject to attack by burglars. Therefore, an important feature of the present invention is the use of a lateral reinforcement adjacent each of the side rails 32, 34. The lateral reinforcements are implemented using wave rebars 58, 60 that are located in the frame 48 adjacent the longitudinal bars 62, 64 closest to the side rails 32, 34. The wave rebars 58,60 have a height approximately equal to the thickness of the panel frame 48. The wave rebars 58, 60 are normally constructed from grade 60, #3 wave rebar stock. The wave rebars 58, 60 are rigidly connected, for example, by welding, to the respective adjacent longitudinal rods 62, 64 at their points of intersection 66. The pattern of welds connecting the wave rebars 58, 60 to the longitudinal rods 62, 64 may be varied in a known manner.

The rebar lattice 54 further includes a plurality of transverse bars or rods 68 that extend across the width of the panel 30 on top of and approximately perpendicular to the longitudinal rods 56 at a spacing of approximately 6.5 inches. The transverse rods 68 are welded to the inside upper surface 69 of the step 46 on the side rail 32 thereby connecting the transverse rods 68 to the panel frame 48 (FIG. 3). Thus, the transverse rods 68 and longitudinal rods 56 are rigidly connected together, for example, by welding, to form a lattice 54 having an approximately square grid of approximately 6.5 inches on a side.

After the frame 48 has been constructed, it is filled with a known high compression strength, attack resistant concrete 71. Such a concrete is made from a mix including a Portland cement with pozzolan such as fly ash, silica, fume or slag. The mix includes a course aggregate such as a trap rock that meets the No. 8 size gradation requirements of ASTM C33 and/or crushed glacial gravel that also meets the No. 8 gradation requirements of ASTM C33. A fine aggregate is also used in the mix and normally is a natural sand meeting the compositional and gradation requirements of ASTM C33 fine aggregate. The concrete mix further includes steel fiber meeting the requirements of ASTM A820 specification for steel fibers for reinforced concrete. The above materials are mixed into a batch comprised of 23% (by weight) cement materials, 67% aggregate rock and sand, 3% steel fiber, 6% water and admixtures such as a super plasticizer and other admixtures. The concrete cures to a compressive strength of 8,000 psi after 7 days and 12,000 psi after 28 days of curing.

The above-described modular concrete panel is normally manufactured in lengths of from 102 inches or less up to 156 inches or more at widths that are specified by the user. The thickness of the panel is nominally 5 inches which is approximately 1 inch less than the thickness of other panels that meet the class 1 UL 608 specification. Similarly, the thickness of a panel meeting a UL 608 Class 2 specification is approximately 8 inches which is approximately one inch less than other panels meeting the Class 2 specification.

Figures 5, 5A, 5B:
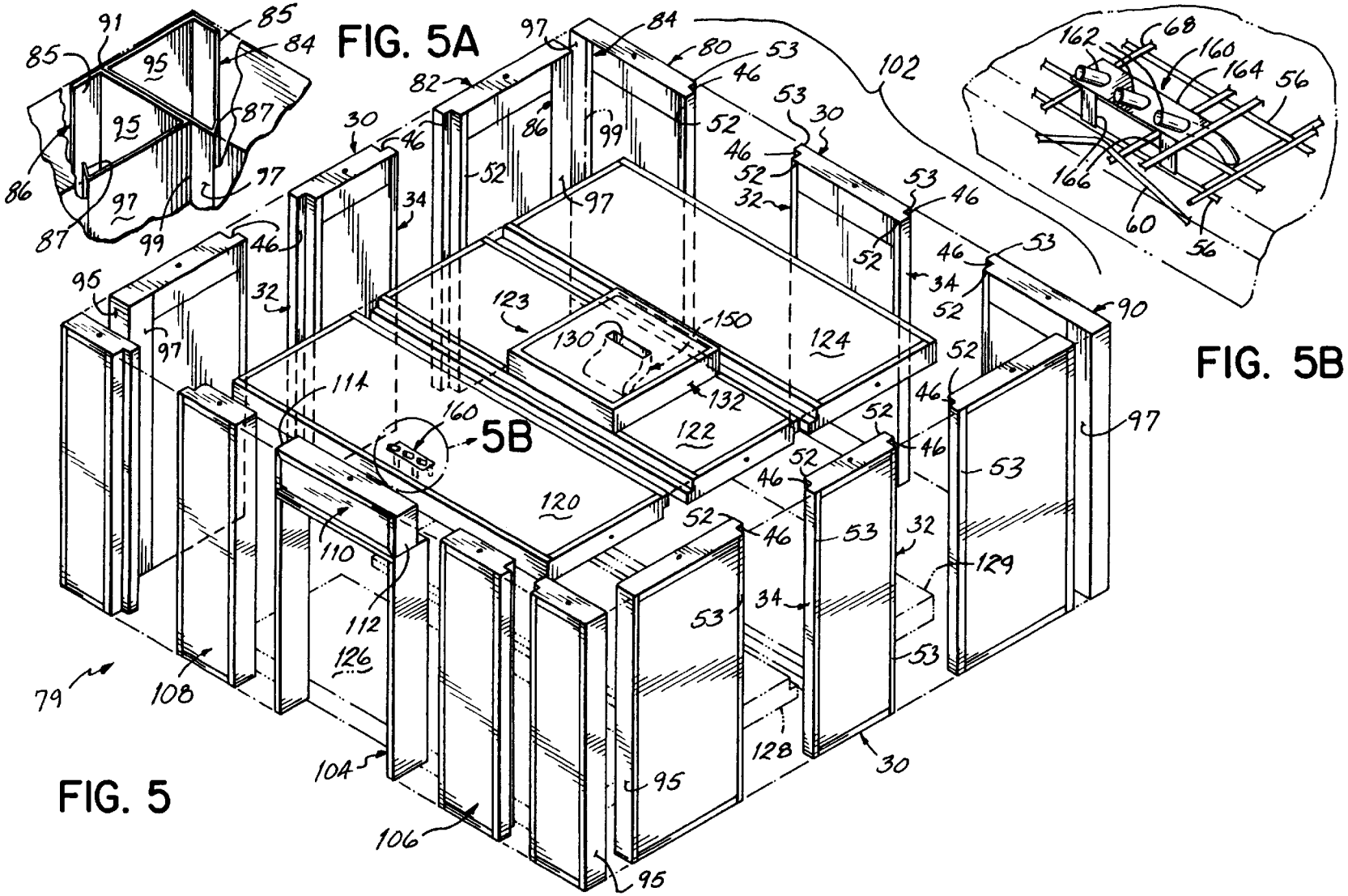
FIG. 5 is a disassembled view of a vault constructed of the modular panels of FIG. 1. in accordance with the principles of the present invention.
FIG. 5A is an enlarged partial view of a corner construction between two end panels of the vault illustrated in FIG. 5.
FIG. 5B is an enlarged view of a conduit assembly shown in the circle of FIG. 5.

In use, referring to FIG. 5, the modular concrete panels are assembled into a vault 79; and as will be appreciated, the profile or shape of one or both of the side rails 32, 34 is varied to facilitate that assembly process. For example, to facilitate a vault corner construction, the profile of one of the side rails of end panels used to form a corner is flat. All of the vault corners are identical in construction, and the corner formed by end panels 80, 82 will be described in detail as being exemplary of the other corners. The end panels 80, 82 have side rails 84, 86, respectively, that are flat with no step across their surface. Normally, to provide the flat side rail profile, the side rails 84, 86 are made from a simple L-shaped rail that is formed from 16 ga steel stock. Referring to FIG. 5A, the L-shaped rails 84, 86 have mutually perpendicular end and inside walls 95, 97, respectively, that are comparable to the end and side walls 40, 42, respectively, of the end cap 31 illustrated in FIG. 2. Each of the rails 84, 86 has an outer lip 85 approximately perpendicular to the outer longitudinal edge of the end wall 95 and an inner lip 87 extending back at an angle from an inner longitudinal edge of the inside surface 97. The width of the inside wall 97 of the L-shaped rails 84, 86 exceeds the width of their respective end wall 95, that is, the thickness of the respective panels 80, 82, by approximately 2 inches. When the panel 80 is abutted against the panel 82, the inside wall 97 of the side rail 84 abuts against the end wall 95 of the side rail 86; and the inside wall 97 of the side rail 84 extends beyond the intersection of the panels 80, 82. Thus, when the panels 80, 82 are brought together, an interior metal corner 99 is formed by the inside walls 97 of the end rails 84, 86. The inside walls 97 of the rails 84, 92 are rigidly connected together at the corner 99, for example, by welding. Similarly, an opposite, outer joint 91 formed by the intersection end walls 95 of the side rails 84, 86 is also rigidly connected together, for example, by welding The end section panels 80, 90 are erected and connected to a number of intermediate wall panels 30 via the stepped side rails 32, 34 to form a vault wall 102 of the desired length. The respective step surfaces 46 of the side rails 32, 34 of the panels 80, 30, 90 overlap to interlock and form a ship joint. The panels 80, 30, 90 are rigidly connected together, for example, by welding the adjacent respective inner and outer lips 52, 53 of the side rails 32, 34. Thus, as will be appreciated, the modular vault panels are manufactured to the desired size and in the appropriate number to construct a vault having the desired size.

A door frame 104 is welded to adjacent wall panels 106, 108 having the identical construction as the end panel 80 described above. A header panel 110 is also the same internal construction, but has flat side rails 112, 114 utilizing the same L-shaped side rail described above with respect to the end panel 80.

Figure 8:
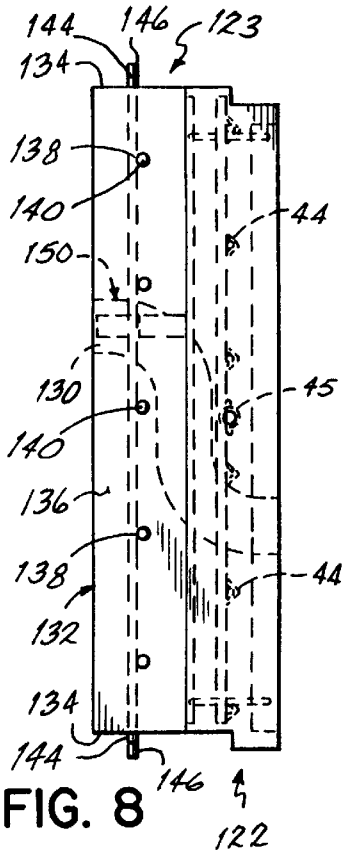
FIG. 8 is a side view of the modular concrete panel of FIG. 6.
Figure 6:
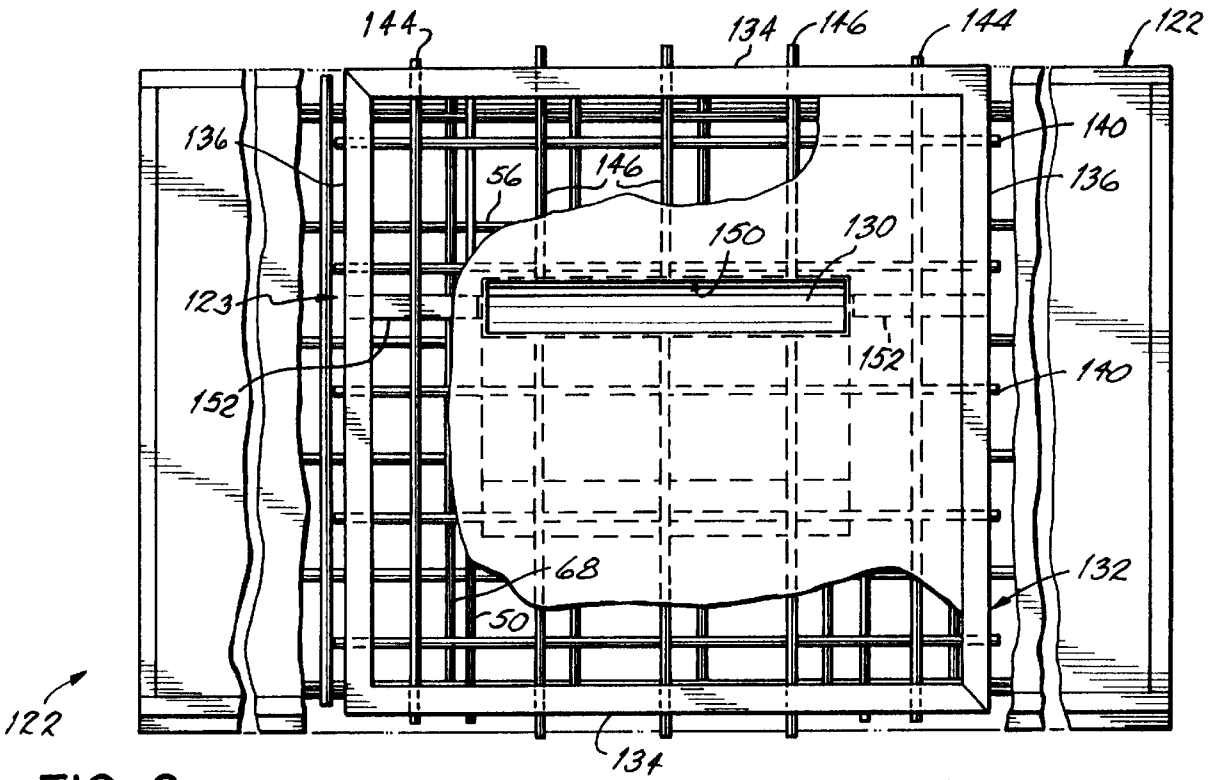
FIG. 6 is a bottom plan view of the modular concrete panel having a ventilation opening in accordance with the principles of the present invention.
Figure 7:
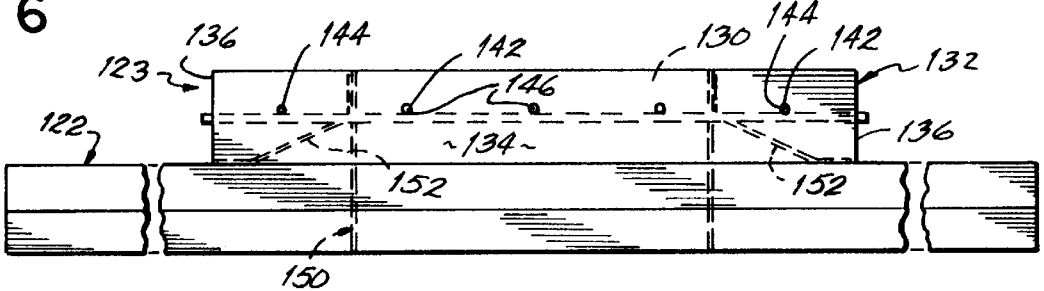
FIG. 7 is an end view oft he modular concrete panel of FIG. 6.

A plurality of ceiling panels 120, 122, 124 are identical in their construction to the wall panels 80, 30, 90 previously described. With the singular exception that a ventilation assembly may be utilized in one of the ceiling panels 122 to provide ventilation air to the vault. Referring to FIGS. 6–8, the ceiling panel 122 includes a ventilator 123 formed by a ventilator frame 132 having a ventilation opening 130 that extends through the thickness of the panel 122. The ventilator opening 130 provides a path for ambient air to enter the interior of the vault. The quadrilateral frame 132 has two opposed side walls 134 and two opposed end walls 136. The side walls 134 are rigidly connected to the side walls 32, 34 of the panel 122, for example, by fasteners, welding or other known techniques.

Each of the end walls 136 includes a plurality of holes 138 that have a common elevation for locating longitudinal bars or rods 140. The holes 138 are sized to easily receive the bars 140 and the ends of the bars 140 extend beyond the end walls 136 of the ventilator 132. Each of the side walls 134 has a plurality of holes 142 at a common elevation for locating transverse bars or rods 144, 146. The outermost transverse rods 144 have ends extending through the opposite side walls 134 of the ventilator 132. The interior transverse rods 146 are cut off to prevent the rods 146 from entering the ventilation channel 130, and thus, only one end of the rods 146 extends through the side walls 134. The transverse rods 144, 146 rest on top of the longitudinal rods 140. The bars or rods 140, 144, 146 are welded at their points of intersection. Further, the ends of the rods 140, 144, 146 are welded at their points of intersection with the side walls 134 and end walls 136.

The ventilator space 130 is created by a generally S-shaped sheet metal ventilator channel 150 that has mounting straps 152. One end of the mounting straps 152 is rigidly connected, for example, by fasteners or welding, to the channel 150, and the other ends of the mounting straps 152 are similarly rigidly connected to the end walls 136. As will be appreciated, referring to FIG. 8, the ventilator channel 150 may also be rigidly connected to one of the longitudinal bars 56. The space inside the ventilation frame 132 is filled with a high compressive strength, reinforced concrete.

A vault floor may be fabricated by similarly constructed panels 126, 128, 129 shown in phantom in FIG. 5. Alternatively, the vault may be constructed on a poured concrete floor and the side walls, for example, side wall panels 80, 30, 82 are secured in a known manner to studs anchored within the concrete floor.

As will be appreciated, openings may be provided through the modular panels of the vault to run wires for security, lighting and other purposes. For example, referring to FIGS. 5 and 5B, ceiling panel 120 includes a conduit assembly 160 comprised of a plurality of curved tubes 162 made from steel tubing rigidly connected to a plate 164. The plate 164 includes supports 166 that are welded to a longitudinal rod 56. The poured concrete further secures the conduit assembly 160 within the panel 120. As will be appreciated, one or more conduit assemblies 160 may be provided in the panel 120 or in other wall, ceiling or floor panels.

While the present invention has been illustrated by a description of various embodiments, and while these embodiments have been described in considerable detail, it is not the intention of Applicants to restrict or in any way limit the scope of the appended claims to such detail. Additional advantages and modifications will readily appear to those skilled in the art. For example, as shown in FIG. 1, the transverse rebar rods 68 are rigidly connected at only one end to the side rail 32; however, as will be appreciated, the opposite ends of the rebar rods 68 may be rigidly connected, for example, by welding, to the opposite side rail 34.

Thus, the invention in its broader aspects is not limited to the specific details, representative apparatus and method, and illustrative example shown and described. Accordingly, departures may be made from such details without departing from the spirit or scope of Applicants' general inventive concept.

What is claimed is:

1. A modular vault panel comprising:

a pair of opposed metal side rails;

a pair of opposed metal end rails having ends rigidly connected to ends of the side rails to form a metal rectangular frame;

at least one first tie bar having each end rigidly connected to a different one of the side rails intermediate the end rails;

at least one second tie bar having each end rigidly connected to a different one of the side rails intermediate the end rails;

a rebar lattice supported within the frame, wherein the rebar lattice is supported intermediate the at least one first tie bar and the at least one second tie bar;

a pair of waveform rebars, wherein each waveform rebar extends longitudinally within the frame adjacent a different one of the side rails; and wherein the frame is adapted to be filled with high compression strength concrete substantially surrounding the rebar lattice and the pair of waveform rebars.

2. The modular vault panel of claim 1 wherein the rebar lattice is rigidly connected to the rectangular frame.

3. The modular vault panel of claim 1 wherein the rebar lattice is rigidly connected to the pair of waveform rebars.

4. The modular vault panel of claim 1 wherein each of the side rails comprises:

an inner side wall portion;

an outer side wall portion;

a locking wall portion connected to inner lateral edges of the inner and outer side wall portions, the locking wall portion being approximately perpendicular to the inner and outer side wall portions and forming a step therewith.

5. The modular vault panel of claim 4 wherein each of the side rails further comprises:

an outer lip connected to an opposite lateral edge of the outer side wall portion and extending approximately perpendicularly therewith; and an inner lip connected to an opposite lateral edge of the inner side wall portion and extending in the same direction as the outer lip.

6. The modular vault panel of claim 1 wherein each of the end rails comprises:

an end wall;

an inside wall having a lateral edge rigidly connected to one lateral edge of the end wall, the inside wall being approximately perpendicular to the end wall.

7. The modular vault panel of claim 6 wherein each of the end rails further comprises:

an outer leg having a lateral edge rigidly connected to an opposite lateral edge of the end wall and extending approximately perpendicularly from the end wall in the same direction of the inside wall; and an inner leg having a lateral edge rigidly connected to an opposite lateral edge of the inside wall and extending approximately perpendicularly from the inside wall in the same direction of the end wall.

8. The modular vault panel of claim 6 wherein a width of the inside wall is greater than a width of the end wall.

9. The modular vault panel of claim 7 wherein the inner and outer legs are L-shaped.

10. The modular vault panel of claim 1 wherein the rebar lattice includes a pair of lateral rebar rods, each of the lateral rebar rods extending longitudinally within the frame adjacent a different one of the side rails.

11. The modular vault panel of claim 10 wherein each of the lateral rebar rods is rigidly connected to one of the waveform rebars.

12. The modular vault panel of claim 1 wherein the at least one first tie bar includes a plurality of first tie bars, wherein each of the first tie bars has each end rigidly connected to a different one of the side rails intermediate the end rails.

13. The modular vault panel of claim 1 wherein the at least one second tie bar includes a plurality of second tie bars, wherein each of the second tie bars has each end rigidly connected to different ones of the side rails intermediate the end rails.

14. The modular vault panel of claim 13 wherein the rebar lattice includes a first plurality of rebar rods extending longitudinally in the frame with common ends of the first plurality of rebar rods being rigidly connected to different ones of the end rails.

15. The modular vault panel of claim 14 wherein the rebar lattice includes a second plurality of rebar rods extending transverse to the first plurality of rebar rods, the second plurality of rebar rods having common ends rigidly connected to one of the side rails.

16. The modular vault panel of claim 15 wherein the first plurality of rebar rods and the second plurality of rebar rods are rigidly connected together at a plurality of locations.

17. The modular vault panel of claim 1 further comprising high compression strength concrete substantially filling the frame and substantially surrounding the rebar lattice and the pair of waveform rebars.

18. A modular concrete vault panel comprising:

a first pair of opposed metal side rails;

a first pair of opposed metal end rails having ends rigidly connected to ends of the first side rails to form a first rectangular metal frame;

a first rebar lattice supported within the first frame;

a second pair of opposed metal side walls located on top of the first pair of metal side rails;

a second pair of opposed metal end walls having ends rigidly connected to ends of the second side walls to form a second rectangular metal frame;

a second rebar lattice supported within the second frame;

a ventilation channel extending through the first and second frames; and high compression strength concrete within the first and second frames surrounding the first rebar lattice, the second rebar lattice and the ventilation channel.

19. The modular concrete vault panel of claim 18 wherein the first pair of metal side rails is rigidly connected to the second pair of metal side walls.

20. The modular concrete vault panel of claim 19 wherein the second rebar lattice, the second frame and the ventilation channel are rigidly connected together.

21. A modular vault panel comprising:

opposed metal side rails;

opposed metal end rails having ends rigidly connected to ends of the side rails to form a metal rectangular frame defining a thickness of the vault panel;

a first plurality of rebar rods extending longitudinally in the frame and rigidly connected to the end rails;

a second plurality of rebar rods transverse to the first plurality of rebar rods, the second plurality of rebar rods being rigidly connected to one of the side rails and the first plurality of rebar rods to form a rebar lattice, the rebar lattice having a height less than the thickness of the vault panel;

waveform rebars, one of the waveform rebars having a height about equal to the thickness of the vault panel, and each of the waveform rebars extending adjacent a different one of the metal side rails and being connected to the rebar lattice, wherein the one waveform rebar extends above and below the rebar lattice; and wherein the frame is adapted to be filled with high compression strength concrete substantially surrounding the first plurality of rebar rods, the second plurality of rebar rods, and the waveform rebars.

22. The modular vault panel of claim 21 further comprising high compression strength concrete substantially filling the frame and substantially surrounding the first plurality of rebar rods, the second plurality of rebar rods, and the waveform rebars.

23. A modular concrete vault panel comprising:

a pair of opposed metal side rails;

a pair of opposed metal end rails having ends rigidly connected to ends of the side rails to form a metal rectangular frame;

a tie bar having each end rigidly connected to a different one of the side rails intermediate the end rails;

a rebar lattice supported within the frame;

a pair of waveform rebars, each waveform rebar extending longitudinally within the frame adjacent a different one of the side rails; and high compression strength concrete within the frame surrounding the tie bar, the rebar lattice and the pair of waveform rebars.

24. A modular concrete vault panel comprising:

a pair of opposed metal side rails;

a pair of opposed metal end rails having ends rigidly connected to ends of the side rails to form a metal rectangular frame;

a first tie bar having each end rigidly connected adjacent a first edge of a different one of the side rails intermediate the end rails;

a second tie bar having each end rigidly connected adjacent a second edge of a different one of the side rails intermediate the end rails;

a rebar lattice supported within the frame;

a pair of waveform rebars, each waveform rebar extending longitudinally within the frame adjacent a different one of the side rails; and high compression strength concrete within the frame surrounding the first and second tie bars, the rebar lattice and the pair of waveform rebars.

25. A modular vault panel comprising:

a pair of opposed metal side rails;

a pair of opposed metal end rails having ends rigidly connected to ends of the side rails to form a metal rectangular frame defining a thickness of the vault panel;

at least one first tie bar having each end rigidly connected to a different one of the side rails intermediate the end rails;

a rebar lattice supported within the frame, wherein the rebar lattice includes rebar rods extending in a longitudinal direction, wherein each of the rebar rods have ends;

wherein each of the end rails include an end wall and support members, wherein each support member extends inwardly within the frame from an end wall in the longitudinal direction, wherein each support member supports an end of a rebar rod, wherein each support member has an end of a rebar rod located therein;

a pair of waveform rebars having a height about equal to the thickness of the vault panel, and each waveform rebar extending longitudinally within the frame adjacent a different one of the side rails; and wherein the frame is adapted to be filled with high compression strength concrete substantially surrounding the rebar lattice and the pair of waveform rebars.

26. The modular vault panel of claim 25 further comprising high compression strength concrete substantially filling the frame and substantially surrounding the rebar lattice and the pair of waveform rebars.

* * * * *

UNITED STATES PATENT AND TRADEMARK OFFICE

CERTIFICATE OF CORRECTION

PATENT NO. : 6,543,371 B1
APPLICATION NO. : 09/477237
DATED : April 8, 2003
INVENTOR(S) : Gardner It is certified that error appears in the above-identified patent and that said Letters Patent is hereby corrected as shown below:

Column 2, line 64 reads "FIG. 7 is an end view oft he modular" and should read --FIG. 7 is an end view of the modular--.

Column 9, lines 4-27, Claim 21 is incorrect. Claim 21 should read:

--21. A modular concrete vault panel comprising:
a pair of opposed metal side rails, each of the side rails comprising
an inner side wall portion,
an outer side wall portion, and
a locking wall portion connected to inner lateral edges of the inner and outer side wall portions, the locking wall portion being approximately perpendicular to the inner and outer side wall portions and forming a step therewith;
a pair of opposed metal end rails having ends rigidly connected to ends of the side rails to form a metal rectangular frame;
a tie bar having each end rigidly connected to a different one of the side rails intermediate the end rails;
a rebar lattice supported within the frame;
a pair of waveform rebars, each waveform rebar extending longitudinally within the frame adjacent a different one of the side rails; and
high compression strength concrete within the frame surrounding the tie bar, the rebar lattice and the pair of waveform rebars.--

Signed and Sealed this

Twenty-second Day of January, 2008

JON W. DUDAS
*Director of the United States Patent and Trademark Office*